United States Patent [19]

Wormington

[11] 4,192,286

[45] Mar. 11, 1980

[54] HEAT EXCHANGER

[76] Inventor: Garold L. Wormington, 600 S. Scenic, Springfield, Mo. 65802

[21] Appl. No.: 864,599

[22] Filed: Dec. 27, 1977

[51] Int. Cl.[2] ..... F24B 7/00

[52] U.S. Cl. ..... 126/121; 126/164

[58] Field of Search ..... 126/120, 121, 164, 165

[56] References Cited

U.S. PATENT DOCUMENTS

| | | | |
|---|---|---|---|
| 698,502 | 4/1902 | Hosea | 126/120 |
| 2,414,033 | 1/1947 | Flaacke | 126/164 |
| 3,289,667 | 12/1966 | Nelson | 126/165 |
| 3,756,218 | 9/1973 | Simpson | 126/121 |
| 4,020,824 | 5/1977 | Dodson | 126/164 |
| 4,050,441 | 9/1977 | Horwinski | 126/165 |
| 4,074,681 | 2/1978 | Whitely | 126/121 |
| 4,076,012 | 2/1978 | Meeker | 126/121 |

FOREIGN PATENT DOCUMENTS

| | | | |
|---|---|---|---|
| 212340 | 3/1924 | United Kingdom | 126/164 |
| 749073 | 5/1956 | United Kingdom | 126/121 |
| 1095644 | 12/1967 | United Kingdom | 126/121 |

*Primary Examiner*—Ronald C. Capossela
*Attorney, Agent, or Firm*—Head & Johnson

[57] ABSTRACT

A heat exchanger for use in a fireplace, or the like, and comprising an angularly disposed plate for supporting fuel for burning, a hot air chamber disposed beneath the plate and having a vent for inward passage of cool air and the exhaust of hot air into the area surrounding the fireplace, a blower mounted in the hot air chamber for facilitating the inward air draft and the venting of the hot air therefrom, and a vent in the proximity of the fuel for discharging air directly into the bottom of the fuel bed for facilitating the burning process.

6 Claims, 4 Drawing Figures

HEAT EXCHANGER

BACKGROUND OF THE INVENTION

1. Field of the Invention

This invention relates to improvements in heat exchangers and more particularly, but not by way of limitation, to a heat exchanger for use in combination with a fireplace for increasing the burning efficiency of the fuel and heat recovery therefrom.

2. Description of the Prior Art

There are many devices available today adapted to be disposed or installed within the usual fireplace recess in a residence, building, or the like, for the burning of coal or wood. These fireplaces are normally provided with a chimney having suitable draft means provided therein whereby a draft is maintained in the proximity of the burning fuel in order that the smoke will be discharged through the chimney at the same time the heat from the burning fuel is dispersed into the area surrounding the fireplace. These devices are frequently provided with tubes or pipes having one end open to the hot area in the proximity of the burning fuel and the opposite end open or in communication with the area surrounding the fireplace which is to be warmed by the burning fuel. Usually, the volume of air moving through these devices is relatively great, and the static pressure in the tubes reduces the flow of air, and as a result the heating efficiency is reduced. In addition, the methane gasses are normally pulled upwardly through the chimney rather violently by the chimney draft and are quickly removed from the burning area a sufficient distance that the temperature is not sufficiently great for burning of the methane, and as a result the methane gasses are normally discharged with the exhaust gasses and not burned. There is also usually an insufficient supply of oxygen at the burning site for achieving an efficient burning of the fuel.

SUMMARY OF THE INVENTION

The present invention contemplates a novel heat exchanger adapted to be disposed or installed within the usual fireplace for supporting coal and/or logs for burning, and which is particularly designed and constructed for overcoming the foregoing disadvantages. The novel apparatus comprises a housing having an upper angularly disposed heat exchanger plate for supporting the coal and/or logs thereon during the burning process. A hot air chamber is provided directly beneath the exchanger plate and is provided with a vent for admitting cool air into the chamber and exhausting hot air therefrom. A suitable blower apparatus is disposed within the chamber for facilitating the flow of air therethrough, and additional vent means is provided in the chamber whereby a relatively thin stream of air is constantly directed to the bottom of the fuel bed during the burning operation for increasing the burning efficiency. The novel heat exchanger may be quickly and easily installed within a fireplace, and is of a simple and economical construction.

DESCRIPTION OF THE PREFERRED EMBODIMENT

Figure 1:
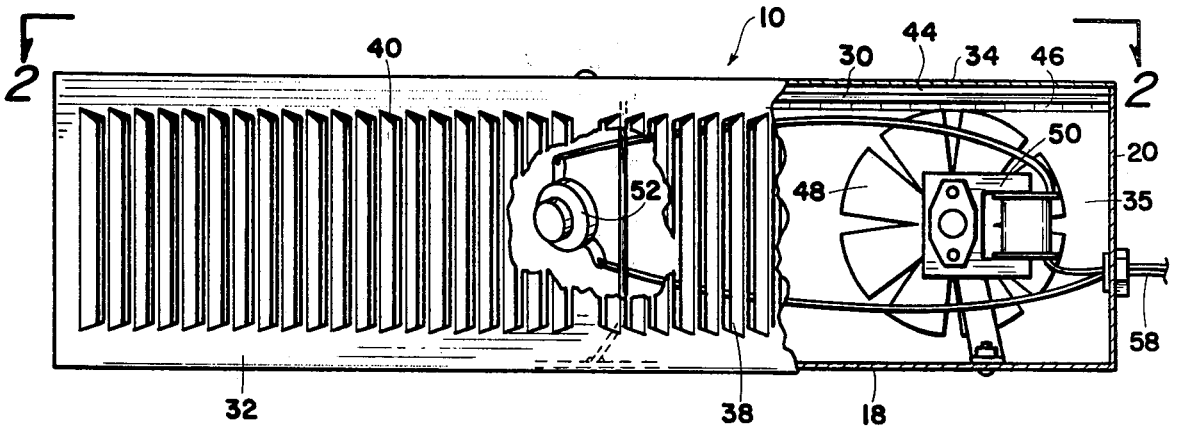
FIG. 1 is a front elevational view of a heat exchanger embodying the invention, with a portion thereof cut away for purposes of illustration.
Figure 3:
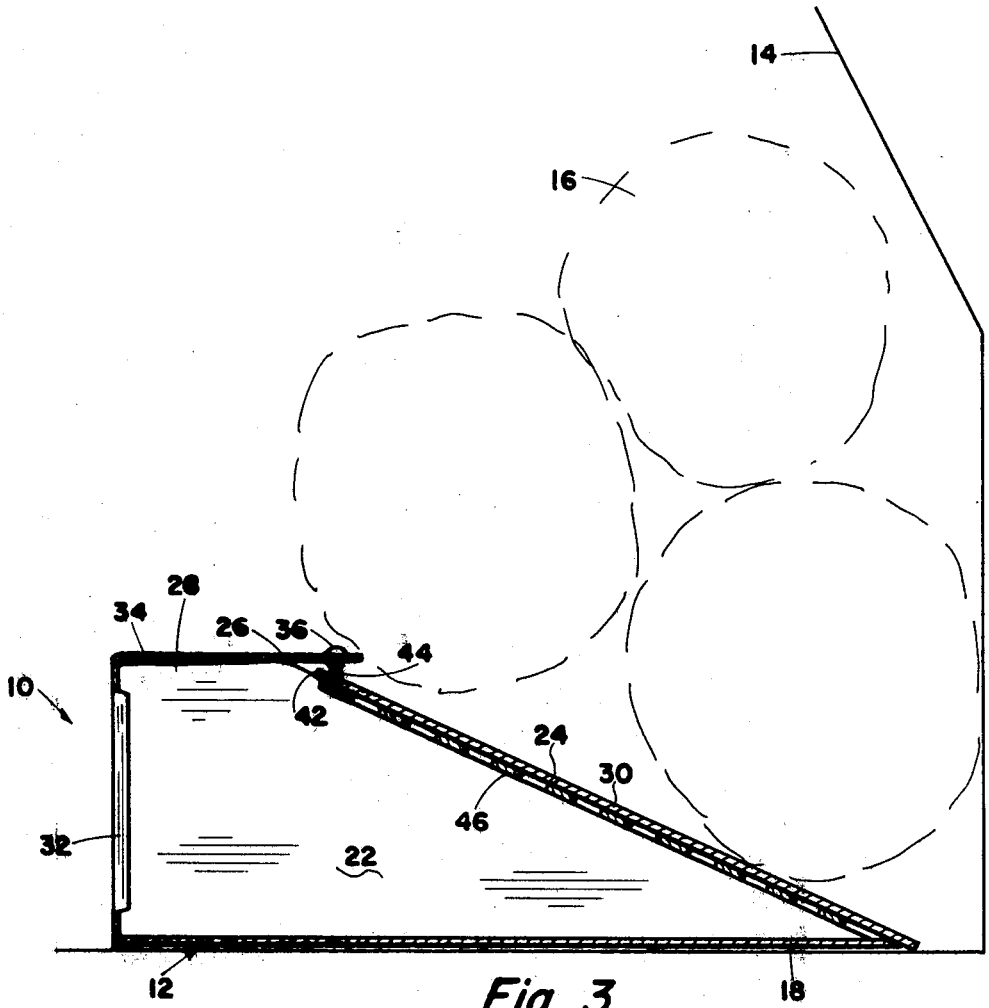
FIG. 3 is a view taken on line 3—3 of FIG. 2.

Referring to the drawings in detail, reference character 10 generally indicates a heat exchanger comprising a housing 12 adapted to be disposed within the usual fireplace 14 for supporting a suitable fuel, such as logs 16 or the like, in a manner for an efficient burning of the fuel and distribution of the heat from the burning process into the area surrounding the fireplace 14. The housing 12 comprises a substantially rectangular bottom plate 18 having a pair of oppositely disposed upstanding side plates 20 and 22 secured thereto in any suitable manner, such as by welding, or the like. The side plates 20 and 22 are substantially wedge-shaped, each having an angularly disposed edge portion 24 extending upwardly from the rear edge of the plate 18 and terminating at a point 26 spaced rearwardly from the front edge of the plate 18, as particularly shown in FIG. 3. Each plate 20 and 22 is provided with a substantially straight portion 28 extending from the point 26 to the front of the plate 18, and disposed substantially parallel with the plane of the plate 18. A substantially flat, rectangular plate 30 is disposed against each of the angular edges 24 and spans the distance therebetween to provide a heat exchanger plate for receiving the fuel 16 therein in a manner and for a purpose as will be hereinafter set forth. A suitable vent plate 32 is removably secured to the front edge of the plate 18 and is provided with a rearwardly extending flange 34 removably engagable with the edges 28 and spanning the distance therebetween whereby the vent plate 32 provides a removable front element for the housing 12, thus enclosing the housing whereby the interior thereof becomes a hot air chamber 35 (FIG. 1). The flange 34 may be removably secured to the heat exchanger plate 30 by a plurality of suitable screws 26, if desired, for providing said removability for the vent plate 32.

The vent plate 32 preferably includes a first set of spaced elongated vent slots 38 having at least one side edge thereof extending angularly inwardly into the chamber 33 in a left hand direction as viewed in the drawings, and a second set of similar spaced elongated vent slots 40 having at least one side edge thereof extending angularly inwardly into the chamber 33 in a right hand direction for a purpose as will be hereinafter set forth. In addition, the upper edge 42 for the angularly disposed heat exchanger plate 24 terminates in spaced relation with respect to the point 26 whereby a hiatus 44 is provided between the exchanger plate 30 and the flange 34, providing a rearwardly extending vent opening from the chamber 33. In addition, it is preferable to provide an expanded metal or mesh heat exchanger grate 46 in the chamber 33 and in intimate engagement with the inner surface of the exchanger plate 30 whereby air will flow through the openings of the grate for cooling of the plate 30 in order to reduce the temperature of the plate 30 during a burning operation, thus precluding damaging temperature levels that may build up in the usual fireplace utilizing devices available today.

Figure 2:
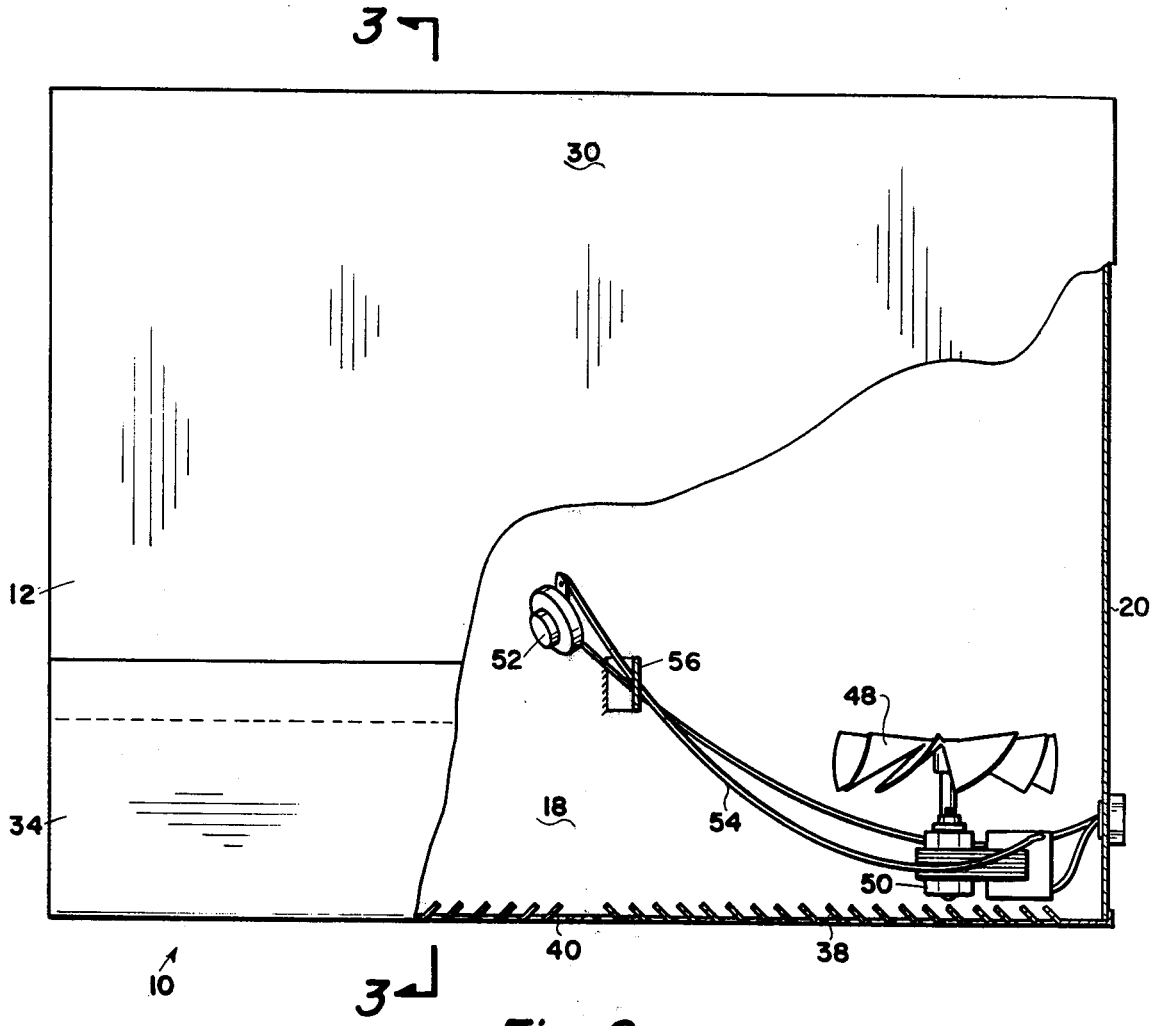
FIG. 2 is a view taken on line 2—2 of FIG. 1, with a portion thereof cut away for purposes of illustration.

An open type blower 48 powered by a suitable electric motor 50 is mounted within the chamber 33 and secured to the housing 12 in any well known manner (not shown) for a purpose as will be hereinafter set forth. A suitable thermostat 52 is suspended in a substantially central position within the chamber 33 and is electrically connected in series with the motor 50 by suitable high temperature asbestos wiring 54. The wiring 54 preferably extends through or is suitably connected with an internal flange 56 (FIG. 2) provided on the inner periphery of the housing 12, and is sufficiently "stiff" or rigid for supporting the thermostat in the suspended position within the chamber 33. The motor 50 is suitably electrically connected with the usual power cord 58 which is provided with the usual electric plug (not shown) at the outer end thereof whereby the motor 50 may be operably connected with the usual house current normally available at the site of a fireplace.

Figure 4:
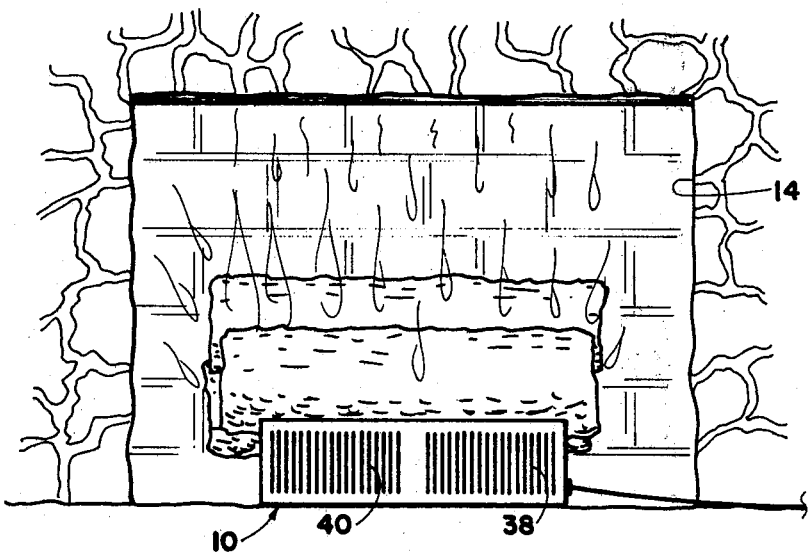
FIG. 4 is a front elevational view of a fireplace having a heat exchanger embodying the invention disposed therein.

In use, apparatus 10 may be disposed within the fireplace 14 in such a manner that the rearward or downwardly disposed edge of the heat exchanger plate 30 is disposed in the proximity of the rear wall of the fireplace, and the vent plate 32 is open to the area surrounding the fireplace opening. The motor 50 may be operably connected with the house current in the normal manner whereby electric current is constantly supplied to the motor through the power cord 58. However, the actuation of the motor 50 is controlled by the ambient temperature in the proximity of the thermostat 52 whereby the motor 50 is activated only when the temperature within the chamber 33 reaches a predetermined or preselected degree. The fuel 16, such as logs, coal, or the like, is disposed on the heat exchanger plate 32, as shown in FIG. 4, and may be ignited in any well known or usual manner (not shown).

As the fuel burns, the temperature of the heat exchanger plate 30 increases and the heat is transmitted into the chamber 33 through the heat grid 46. When the heat in the chamber 33 reaches a predetermined degree, the thermostat 52 energizes the motor 50 for actuation of the blower 48. When the blower 48 is in operation, relatively cool air is drawn into the chamber 33 through one set of vent openings, such as the set 38, and discharges from the chamber 33 through the other set of vent openings, such as the set 40. The open type construction of the interior of the housing 12 provides a substantially unrestricted flow of air through the chamber 33 which greatly increases the BTU output of the apparatus 10. In addition, the retrieval of heat from the bottom of the burning chamber reduces the heat in the chimney, which reduces the draw through the chimney and provides a longer burning time for the fuel, as well as applying more hot air directly into the area surrounding the fireplace and reducing heat loss through the chimney.

As the air is circulated through the chamber 33, a steady, relatively thin stream of air is discharged through the vent or hiatus 44 directly into the area at the bottom of the fuel, which assures a constant supply of oxygen to forge the fuel to a very hot burning temperature. This assures a sufficiently high temperature for the burning of the methane gasses, thus further increasing the efficiency of the burning process.

It is preferable that the motor 50 be of the open frame, long life type, and the blower is an axial blower, such as that known as the Dayton Straight Axial Induction Motor, manufactured by Dayton Manfacturing Company, but not limited thereto. This type motor, in combination with the blower and high temperature wiring assures an efficient operation of the apparatus 10 in the relatively high temperatures encountered in the chamber 33. Of course, when the temperature in the chamber 33 drops below the preselected degree, the thermostat 52 will sense the temperature drop and stop the operation of the motor and blower until such time as the temperature within the chamber 33 again reaches the preselected degree.

From the foregoing it will be apparent that the present invention provides a novel heat exchanger for facilitating the burning of fuel within the usual fireplace. The heat exchanger is of a substantially wedge-shaped overall configuration and may be quickly and easily installed within a presently available fireplace for supporting a quantity of fuel, such as coal or logs, thereon. An air chamber is provided in the apparatus disposed beneath the burning fuel and as the air in the chamber is heated, blower means is activated for venting the hot air into the area surrounding the opening of the fireplace. In addition, a rearwardly open vent is provided for directly a relatively thin stream of air directly to the bottom of the burning fuel chamber for providing an efficient supply of oxygen for forging the fuel to a very hot burning temperature, which results in an efficient and effective burning process. The design of the heat exchanger housing retrieves hot air from the hot air chamber and distributes the hot air in an efficient manner for warming of the area surrounding the apparatus.

Whereas the present invention has been described in particular relation to the drawings attached hereto, it should be understood that other and further modifications, apart from those shown or suggested herein may be made within the spirit and scope of this invention.

What is claimed is:

1. A method of producing heat from a fireplace which comprises providing an air chamber beneath a heat exchanger plate, supporting a source of fuel substantially immediately above the air chamber, directing a relatively thin stream of air to the proximity of the bottom of the fuel source during a burning operation, circulating air through the air chamber whereby relatively cool air is drawn into the air chamber and hot air is discharged therefrom into the area surrounding the fireplace, directing a relatively thin elongated stream of air into the fire area, and reducing the temperature of the heat exchanger plate during a burning operation.

2. A heat exchanger for supporting fuel in a fireplace and comprising a substantially horizontally disposed bottom plate, a heat exchanger plate disposed above the bottom plate and at a planar angle with respect thereto for receiving fuel thereon, air chamber means disposed between the heat exchanger plate and bottom plate for receiving heat from the heat exchanger plate, vent means providing communication between the air chamber means and the atmosphere for circulation of air there-between, and a heat exchanger grid plate disposed in said air chamber means and in intimate engagement with the heat exchanger plate for reducing the heat of the heat exchanger plate during a burning operation.

3. A heat exchanger for supporting fuel in a firplace and comprising a substantially horizontally disposed bottom plate, a heat exchanger plate means disposed above the bottom plate and at an acute planar angle with respect thereto for receiving the fuel thereon, air chamber means disposed between the heat exchanger plate means and the bottom plate for receiving heat from the heat exchanger plate means, vent means providing communication between the air chamber means and the atmosphere for circulation of air therebetween, and second vent means disposed rearwardly of the first mentioned vent means and forwardly of the rear of the heat exchanger plate means for discharge of air therefrom into the proximity of the bottom of the fuel, said second vent means comprising an elongated relatively narrow opening directed thin elongated stream of air to the fuel.

4. A heat exchanger as set forth in claim 3 wherein the angular disposition of the heat exchanger plate means extends from a lowermost position at the rear of the bottom plate and extends upwardly and forwardly therefrom.

5. A heat exchanger as set forth in claim 3 and including blower means disposed in said air chamber means for circulation of air therethrough.

6. A heat exchanger as set forth in claim 5 wherein said blower means comprises an electric motor operably connected with a source of electric current, a blower operably connected with the motor for actuation thereby, and thermostat means disposed within said air chamber and operably connected with said motor for selective actuation thereof in response to the temperature conditions within the air chamber means.

* * * * *